US006520170B1

(12) United States Patent
Adkins

(10) Patent No.: US 6,520,170 B1
(45) Date of Patent: Feb. 18, 2003

(54) ADJUSTMENT KNOB ASSEMBLY FOR AN ARCHERY BOW

(76) Inventor: Daniel K. Adkins, 13716 Carmenita Rd., Santa Fe Springs, CA (US) 90670

( * ) Notice: Subject to any disclaimer, the term of this patent is extended or adjusted under 35 U.S.C. 154(b) by 0 days.

(21) Appl. No.: 09/924,138

(22) Filed: Aug. 8, 2001

(51) Int. Cl.[7] ..... F41B 5/22; F41G 1/467
(52) U.S. Cl. ..... 124/44.5; 124/87; 33/265
(58) Field of Search ..... 124/24.1, 44.5, 124/86, 87, 88; 33/265

(56) References Cited

U.S. PATENT DOCUMENTS

| | | | | |
|---|---|---|---|---|
| 4,457,076 A | | 7/1984 | Heck | |
| 4,542,731 A | * | 9/1985 | Quartino | |
| 4,548,188 A | * | 10/1985 | Simo | |
| 4,592,332 A | * | 6/1986 | Topping | |
| 4,732,135 A | * | 3/1988 | Simo | |
| 4,809,670 A | * | 3/1989 | Simo | |
| 5,137,006 A | | 8/1992 | Gallops | |
| 5,460,151 A | * | 10/1995 | Hamilton et al. | 124/44.5 |
| 5,526,799 A | * | 6/1996 | Simo | 124/44.5 |
| 6,050,251 A | * | 4/2000 | Harwath et al. | 124/44.5 |
| 6,178,959 B1 | * | 1/2001 | Troncoso et al. | 124/44.5 |

* cited by examiner

*Primary Examiner*—John A. Ricci
(74) *Attorney, Agent, or Firm*—Edgar W. Averill, Jr.

(57) ABSTRACT

An adjustment knob assembly for selectably adjusting and securing an arrow deployment parameter of an archery bow. The adjustment knob assembly includes a base block mounted on the archery bow with a base throughbore extending between inner and outer base ends, and an index surface surrounding an outer base aperture leading into the base throughbore. A pivot shaft is rotatably received within the base throughbore and is obstructed from axial displacement in an outward direction. The pivot shaft has one end connected to an adjustment knob and the other end operating to adjust the arrow deployment parameter when rotated by the adjustment knob. Spring-loaded detents of the inner deck engage detent recesses on the index surface as the adjustment knob is rotated to various angular positions. And a preferably screw-type fastener has a threaded shank positioned within a threaded knob throughbore of the adjustment knob, and a knob head connected to the threaded shank which. Grasping and rotating the knob head operates to retractably extend the threaded shank in an inward direction and into press-engagement with the detent recesses. In this manner, the adjustment knob is releasably secured to the base block by a clamping force produced by the press-engagement.

21 Claims, 3 Drawing Sheets

ADJUSTMENT KNOB ASSEMBLY FOR AN ARCHERY BOW

BACKGROUND OF THE INVENTION

The field of the invention pertains to archery equipment. The invention relates more particularly to an adjustment knob assembly utilizing a dual knob configuration which enables toolless hand adjustment and clamp-securing of an arrow deployment parameter of an archery bow.

It is appreciated that a wide variety of accessories and mechanical enhancements have been developed for use with archery bows and crossbows to improve accuracy, range, comfort, etc. Such accessories and enhancements typically enable custom adjustments of various deployment parameters, e.g. horizontal position of an arrow rest, to accommodate a wide range of preferences. Moreover, knob assemblies have been commonly used to effect adjustment of such deployment parameters as shown in representative U.S. Pat. Nos. 5,137,006, and 4,457,076.

In the '006 patent, an arrow rest for an archery bow is shown having a rotatable rod assembly 28 mounted on an arm 20 for adjusting the horizontal position of a shuttle 29 carrying an arrow launcher support 32. One end of the rod assembly 28 has a knurled knob 30 rotatably operable for moving a shuttle 29 toward and away from the arm 20. The knurled knob 30 is fastened to a threaded member 34 which extends through a threaded hole in the shuttle 29. This arrangement causes horizontal movement of the shuttle 29 and an arrow launcher support 32 when the knurled knob is rotated. However a mechanism for temporarily securing the knurled knob 30 and the horizontal position is not provided to prevent inadvertent rotation of the knob and shifting of the horizontal position.

In the '076 patent, an adjustable arrow rest is shown having a rotatable adjustment dial which adjusts the spring tension of a torsional coil spring. The adjustment dial has a pin 124 which may be selectably inserted into one of several threaded apertures which surround a bore 64 of a housing block 50. However, in order to make the rotational adjustments, the dial must be pulled in an outward axial direction to pull the pin out from a first aperture, the dial rotated to select a second aperture, and the pin reinserted into the second aperture by a second axial displacement of the dial in an inward direction. Additionally, a clamping screw is provided to threadedly engage one of the threaded apertures to secure the dial to the housing block. Perhaps the greatest problem with this arrangement, however, is the axial displacement of the dial in adjusting the spring tension parameter. Axial displacement of the adjustment knob has a tendency to produce in the user a sensation of imprecision. Moreover, in this arrangement, a user must perform multiple steps in making a single parameter adjustment, i.e. pull dial, select aperture, and insert pin in aperture. Moreover, due to the small head of the clamping screw, an additional tool, namely a screwdriver, would be required to secure the dial to the housing block.

In summary, therefore, there is a need for an adjustment knob device for use with archery bows which incorporates an axially fixed system of parameter adjustment, and which may be manually adjusted by hand without the need for adjustment tools or aids.

BRIEF SUMMARY OF THE INVENTION

It is therefore an object of the present invention to provide a simple and efficient adjustment knob assembly for archery bows and crossbows, which adjusts an arrow deployment parameter without axial displacement of an adjustment knob, so as to enhance the user's sense of adjustment precision.

It is a further object of the present invention to provide an adjustment knob system which is adjustable exclusively by hand manipulation, without the need for additional adjustment tools.

It is a still further object of the present invention to provide a ball-bearing click-adjustment system which selects various angular positions of the adjustment knob without axial displacement of the adjustment knob.

A still further object of the present invention is to provide a ball-bearing click-adjustment system with the ball-bearings protected from exposure to the elements to ensure reliable operation.

A still further object of the present invention is to provide an adjustment knob locking mechanism which utilizes the axially fixed configuration of the adjustment knob to produce a clamped engagement to lock-secure the adjustment knob at a selected angular position.

The present invention is for an adjustment knob assembly for selectably adjusting and securing an arrow deployment parameter of an archery bow. The adjustment knob assembly comprises a base block and means for mounting the base block to the archery bow. The base block has opposite inner and outer base ends, a base throughbore communicating between the inner and outer base ends to define respective inner and outer base apertures, and an index surface of the outer base end which surrounds the outer base aperture and which has at least two detent recesses thereon surrounding the outer base aperture. The assembly also includes a pivot shaft which is received for rotation within the base throughbore. The pivot shaft has an input portion adjacent the outer base aperture and an opposite output portion extending beyond the inner base end, with the output portion having means for selectably adjusting the arrow deployment parameter upon rotation of the pivot shaft. Additionally, the assembly has means for obstructing relative axial displacement of the pivot shaft in an outward direction from the inner base end to the outer base end. And finally, an adjustment knob is provided having opposite inner and outer knob ends, with the inner knob end adjacent the index surface of the base block and fixedly connected to the input portion of the pivot shaft for controlling rotation thereof. The inner knob end has detent means for resiliently-biasing between engaged and disengaged positions with respect to the detent recesses. And the adjustment knob includes fastener means for retractably extending an abutment member from the inner knob end in an inward direction into press-engagement with respect to the detent recesses. In this manner, the adjustment knob is releasably secured to the base block by a clamping force produced by the press-engagement.

DETAILED DESCRIPTION OF THE PREFERRED EMBODIMENTS

Figure 1:
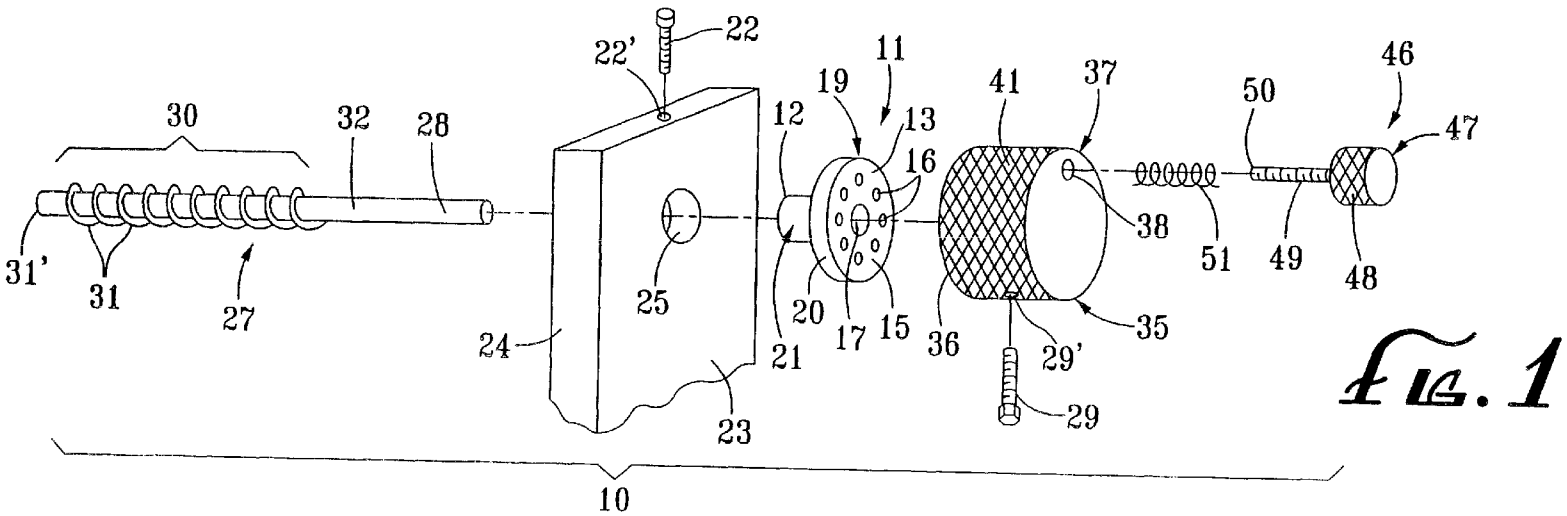
FIG. 1 is an exploded front perspective view of the adjustment knob assembly of the present invention.
Figure 2:
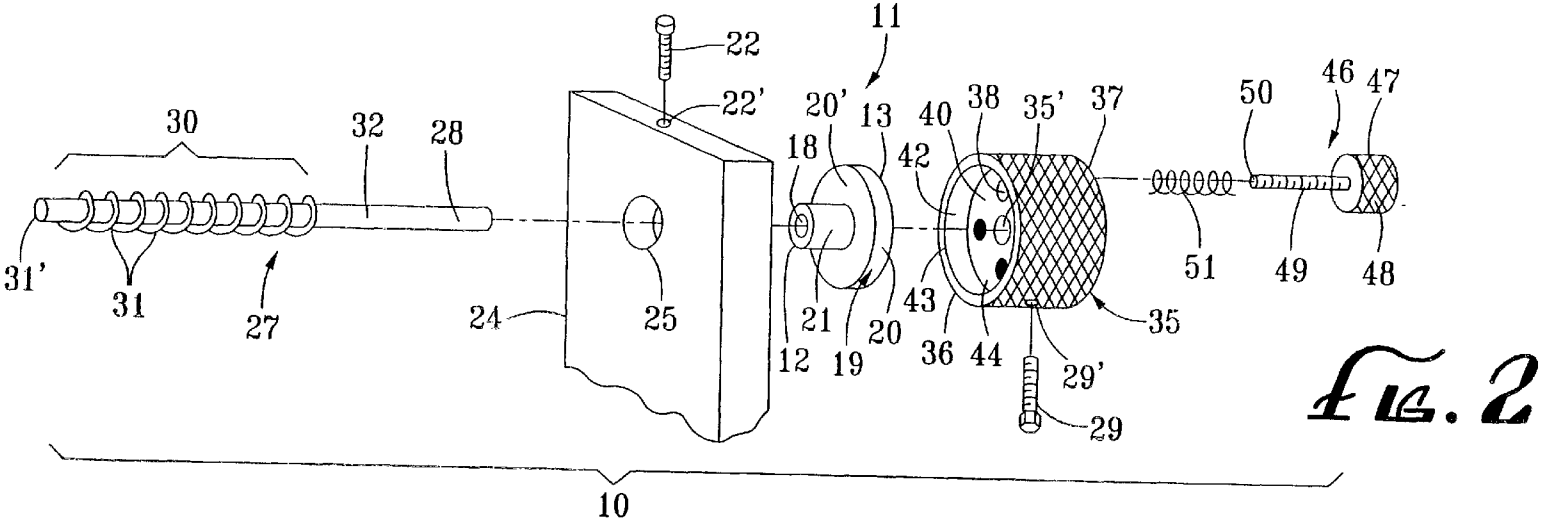
FIG. 2 is an exploded back perspective view of the adjustment knob assembly of the present invention.
Figure 3A:
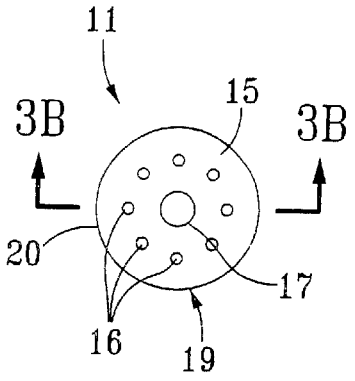
FIG. 3A is a plan view of the outer base end of a first preferred configuration of the base block, detailing the index surface thereof.
Figure 3B:
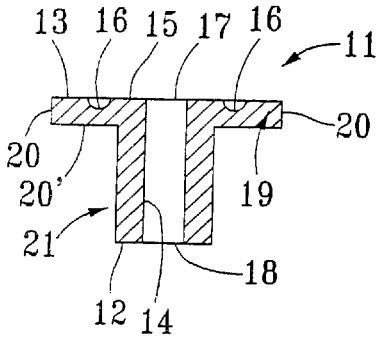
FIG. 3B is a cross-sectional view taken along the line 3B—3B of FIG. 3A, showing the disc-shape of the seat portion in relation to the tubular portion of the first preferred configuration of the base block.
Figure 5:
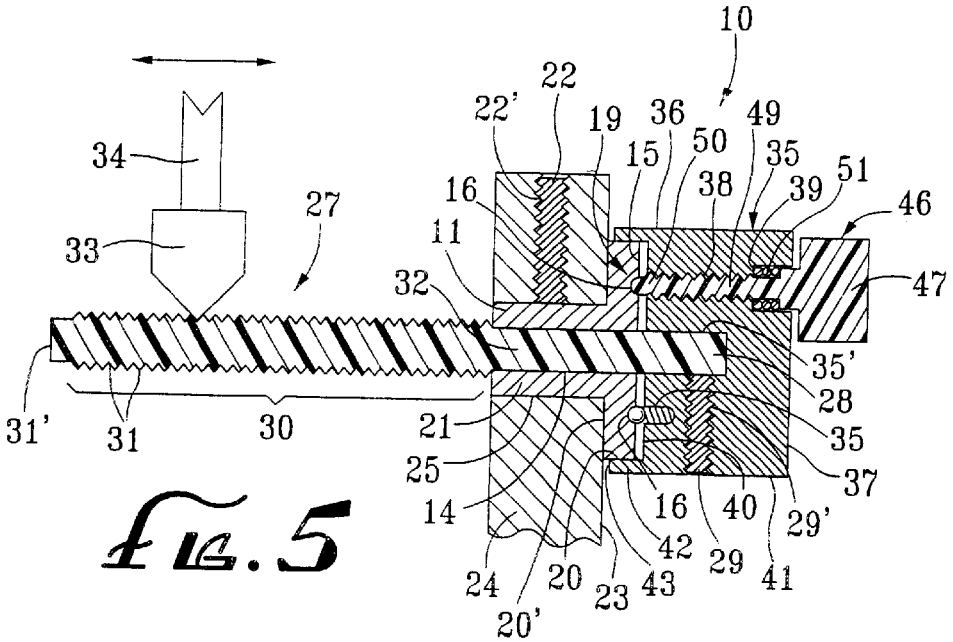
FIG. 5 is an operational cross-sectional view of the adjustment knob assembly of the present invention.

Referring now to the drawings, FIGS. 1, 2 and 5 show a first preferred embodiment of the adjustable knob assembly, generally indicated at reference character 10. The adjustable knob assembly 10 is designed to selectably adjust an arrow deployment parameter of an archery bow (not shown) in order to accommodate the operational preferences of a user. Various arrow deployment parameters may include spacial and angular positions of an arrow rest (34 in FIG. 6), and arrow rest spring tension. It is notable, however, that the term "arrow deployment parameter" is broadly defined to include general operating parameters of the archery bow which may or may not concern or affect an arrow directly, such as a bow sight adjustment. It is also notable that the term "archery bow" is broadly defined to include all configurations of bows, including cross-bows. Moreover, while the present invention is particularly employed for use with archery bows, it is appreciated that guns and firearms may also incorporate the assembly of the present invention for adjustment purposes.

Figure 4A:
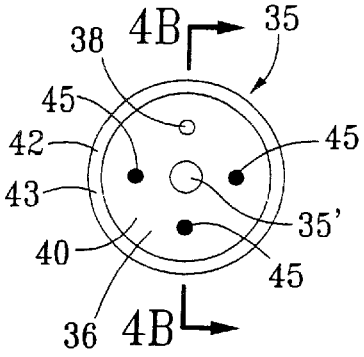
FIG. 4A is a plan view of the inner knob end of a first preferred configuration of the adjustment knob.
Figure 4B:
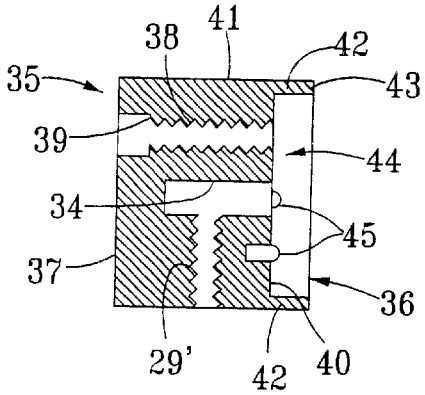
FIG. 4B is a cross-sectional view taken along the line 4B—4B of FIG. 4A, showing the threaded knob throughbore and the ball-bearing detents.

As shown in the figures, the adjustment knob assembly 10 includes a base block, generally indicated at reference character 11, with an inner base end 12 and an opposite outer base end. Preferably, as shown in FIGS. 1–3B and 5, the base block 11 has a tubular trunk portion 21 extending to the inner base end 12, and a disc-shaped seat portion 19 at the outer base end 13. The seat portion 19 has a sidewall 20 which extends between an inner disc surface 20' and an outer index surface 15. A base throughbore 14, shown in FIGS. 3A–B and 5, extends between the inner 12 and outer 13 base ends and centrally through the seat portion 19, to define an inner base aperture 18 at the inner base end 12, and an outer base aperture 17 at the index surface 15 of the outer base end 13. In this manner, the outer base aperture 17 is surrounded by the index surface 15 which is oriented transverse to a central axis of the base throughbore 14. And due to the disc-shape of the seat portion 19, the index surface 15 has a circular perimeter which is concentric with the outer base aperture 13. Additionally, the index surface 15 has at least two detent recesses 16 recessed thereon to receive detents (45 in FIGS. 4A–B, 5) and arranged to surround the outer base aperture 17. The detent recesses 16 function to define pre-set angular positions of an adjustment knob 35, as will be discussed in detail below. Because a greater number of detent recesses spaced closer together can enable finer adjustments of the arrow deployment parameter, a plurality of detent recesses 16 are preferably utilized. Moreover, it is notable that the detent recesses 16 need not be radially spaced equally to each other to outline a uniform circle. Instead, it is appreciated that the detent recesses 16 may be arranged at multiple radial levels to achieve even smaller angular increments not supported by a uniform circular arrangement.

Figure 7:
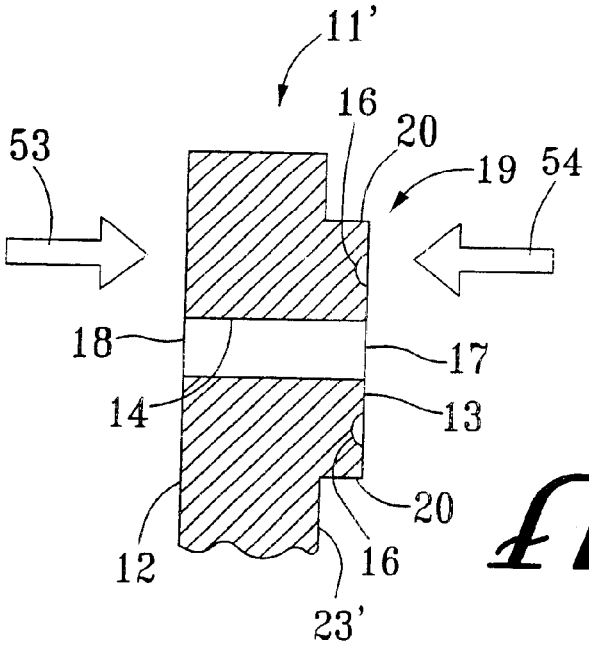
FIG. 7 is a cross-sectional side view of a second preferred embodiment of the base block.

As can be seen in FIGS. 1, 2 and 5, the first preferred embodiment of the base block 11 is mounted on a mounting or support arm 24 of the archery bow. The mounting arm 24 has a central throughbore 25 through which the tubular trunk portion 21 of the base block 11 is telescopically and matingly seated. As can be best seen from FIGS. 1, 2 and 3B, the seat portion 19 has a greater diameter than the trunk portion 21, such that the inner disc surface 20' of the seat portion 19 abuts against an outer reference surface 23 of the mounting arm 24 when mounted on the mounting arm 24. In this mounted position, the base block 11 is fixedly secured to the mounting arm 24 by means of a set screw 22. The set screw 22 is threadedly secured into a threaded throughbore 22' of the mounting arm 24 which orthogonally communicates with the central throughbore 25, to clamp against the trunk portion 21 of the base block 11. When mounted in this manner, the index surface 15 of the seat portion 19 is raised or plateaued above the outer reference surface 23 of the mounting arm 24 as per the width of the sidewall 20 of the seat portion 19. And as shown, the sidewall 20 preferably has a relatively shallow width compared to the distance between the inner 12 and outer 13 base ends. Furthermore, as shown in FIG. 7, it is notable that the base block 11' may alternatively be formed as an integral unit which combines the raised seat portion 19 with a mounting arm or other intermediate component connecting to the archery bow. In this case, the index surface 15 is plateaued above an outer reference surface 23' of the base block 11'.

Figure 6:
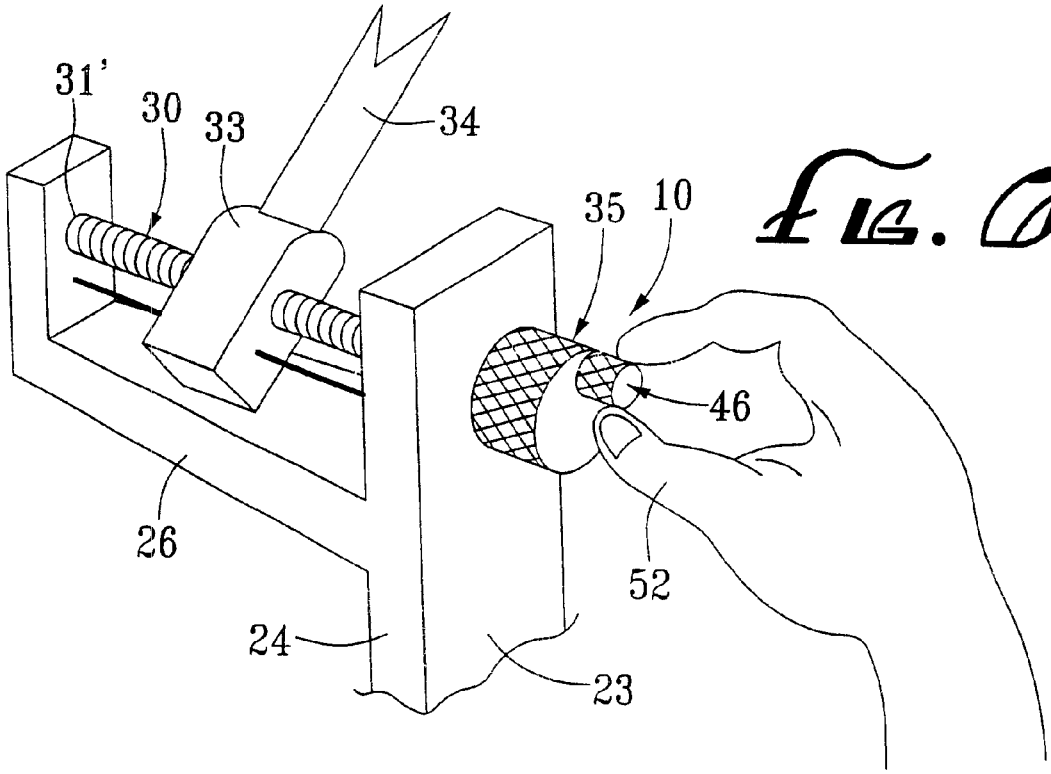
FIG. 6 is a perspective view of the adjustment knob assembly as illustratively employed to adjust a horizontal position parameter of an arrow rest.

The assembly 10 also includes an elongated pivot shaft, generally indicated at reference character 27 in FIGS. 1, 2, and 5. The pivot shaft 27 has an input portion 28 at one end, an opposite output portion 30 at the other end, and a central portion 32 therebetween. The central portion 32 is positioned for rotation within the base throughbore 14, with the input portion 28 positioned adjacent the outer base end 13, and the output portion 30 extending beyond the inner base end 12 to an output portion terminus 31'. As shown in the drawings, the output portion 30 preferably has an external worm-drive thread which operates to adjust the arrow deployment parameter when the pivot shaft 27 is rotated. FIG. 1 shows a schematic illustration of an arrow rest 34 carried by a shuttle 33 which may be adjusted for it horizontal or east-west position by the worm-drive actuation of the output portion 30. The horizontal adjustment example is further illustrated in FIG. 6 showing an extension arm 26 connected to the mounting arm 24, with a vertical portion of the extension arm 26 rotatably supporting the output portion terminus 31'. It is appreciated, however, that other means may be provided with the output portion 30 such that rotation of the pivot shaft 27, and the output portion 30, causes adjustment of the arrow deployment parameter.

Furthermore, the assembly 10 includes means for obstructing relative axial displacement of the pivot shaft 27 in an outward direction (53 in FIG. 7) from the inner base end 12 to the outer base end 13. Relative axial displacement of the pivot shaft 27 is with respect to the base block 11 and particularly the walls of base throughbore 14. Moreover, the obstruction and prevention of relative axial displacement is along the central longitudinal axis of the base throughbore 14, and preferably produced by the worm-drive thread 31 of the output portion 30. As can be best seen in FIG. 5, the worm-drive thread 31 preferably has a thread diameter greater than that of the inner base aperture 18, which effectively prevents insertion from the inner base end 12 of the pivot shaft 27 beyond the central portion 32. It is appreciated, however, that alternative obstructions may also be utilized, such as an annular flange (not shown) between the output 30 and central 32 portions, or by rotatably capturing the output portion terminus 31' with the vertical portion of the extension arm 26 in the arrangement illustrated in FIG. 6. In any event, the obstruction provided against axial displacement of the pivot shaft 27 in an outward direction 53 operates to provide an equal and opposite resistance force necessary to produce a clamping force when a fastener 46 is abutted against the base block 11 in an inward direction (54 in FIG. 7) opposite the outward direction 53, as will be discussed in greater detail below.

An adjustment knob, generally indicated at reference character 35, is also provided for rotating the pivot shaft 27. As can be best seen in FIGS. 1, 2, 4A–B, and 5, the adjustment knob 35 has a generally cylindrical configuration, with a knob grasp surface 41 extending between an inner knob end 36 and an opposite outer knob end 37. The knob grasp surface 41 is preferably knurled to enable facilitated non-slip grip by a user. And the inner knob end 36 is positioned adjacent the index surface 15 of the base block 11 and preferably has an inner deck surface 40 and an annular shoulder 42 surrounding the inner deck surface 40 to form a knob cavity 44. A connector bore 35' preferably extends centrally from the inner deck surface 40 for insertably receiving the input portion 28 of the pivot shaft 27. The input portion 28 is preferably fixedly secured to the adjustment knob 35 by means of a set screw 29 threadedly received within a set screw throughbore 29' communicating between the connector bore 35' and the knob grasp surface 41. In this manner, the adjustment knob 35 is fixedly connected to the input portion 28 of the pivot shaft 27 to cause and control rotation of the pivot shaft 27. Furthermore, as can be best seen in FIG. 5, the seat portion 19 of the base block 11 is telescopically and matingly received within the knob cavity 44, with the index surface 15 confronting the inner deck surface 40. It is notable that the term "confront" is broadly defined herein and in the claims to include a contacting relation, in addition to close-proximity, face-to-face positioning.

Additionally, as shown in FIGS. 2, 4A–B and 5, resiliently biasing detents 45 are provided along the inner deck surface 40 for click-operation of the adjustment knob 35 by engaging and disengaging the detent recesses 16 of the index surface 15. The engaged positions define a set of angular positions of the adjustment knob 35 as it is rotated along with the pivot shaft 27. It is notable that during click-operation, the adjustment knob 35 is axially fixed in an outward direction, as discussed previously, such that the detents 45 resiliently bias into and out of the detent recesses 16, with the detents 45 pressed against the base block 11 at all times. Preferably the resiliently biasing detents 45 are spring-loaded ball-bearings which roll into and out of the engaged positions for facilitated operation. It is also notable that the mating and telescopic relation of the seat portion 19 within the knob cavity 44 ensures that the index surface 15 and the detents 45 are protected by the annular shoulder 42 from exposure to dirt and the elements, for increased reliability.

And finally, the assembly 10 includes fastener means 46 preferably having a generally screw-type configuration, with a threaded shank 49 connected to an enlarged knob head 47. As can be best seen in FIG. 5, the threaded shank 49 is threadedly received within a threaded knob throughbore 38 which connects the inner deck surface 40 with the outer knob end 37. The threaded shank 49 has a leading or abutment end 50 adjacent the inner deck surface 40, and the knob head 47 has a preferably knurled grasp surface 48 by which a user may grasp and rotate the knob head 47. Furthermore, the knob head 47 is positioned beyond the outer knob end 37 where it may be easily grasped and actuated by the fingers 53 (FIG. 6) of a user due in part to its enlarged configuration. The grasp surface 48 of the knob head 47 and its position with respect to the adjustment knob 35 enables manual operation of the fastener 46 without the need for additional adjustment tools or aids. Additionally, a coil spring 51 (FIG. 5) may be seated within the threaded knob throughbore 35' and against an annular shelf 39 thereof to exert a resiliently biasing force against the fastener 46. This arrangement produces increased frictional contact between the threads of the threaded shank 49 and the threaded knob throughbore 38, and thereby operates to prevent inadvertent release of the fastener 46 due to vibrations caused during operation of the archery bow.

With this arrangement of the fastener 46 within the adjustment knob 35, and upon alignment of the threaded knob throughbore 38 with one of the detent recesses 16 of the index surface 15, the knob head 47 may be rotatably actuated to retractably extend the abutment end 50 of the threaded shank 49 from the inner knob end 36 in an inward direction 54 (FIG. 7) into press-engagement with respect to the detent recess 16. For this purpose, the abutment end 50 is preferably contoured to matingly engage the detent recesses 16. And it is notable that the threaded knob throughbore 38 is typically positioned to align with an available detent recess 16 when the detents 45 are engaged with other detent recesses 16. In this manner, retractably extending the abutment end 50 releasably secures the adjustment knob 35 to the base block 11 by a clamping force produced by the press-engagement. It is appreciated that the clamping force is a combination of the abutment force produced by the retractably extended abutment end 50 and the equal and opposite resistance force produced by the obstruction mechanism for preventing relative axial displacement. In this manner, the assembly 10 operates to adjust an arrow deployment parameter, and temporarily secure the arrow deployment parameter at a desired position or setting. Furthermore, it does so without producing axial movement or displacement of the pivot shaft 27 or adjustment knob 35, or otherwise affecting the rotational characteristics of the adjustment knob which can create a perception of imprecision in the user.

The present embodiments of this invention are thus to be considered in all respects as illustrative and restrictive; the scope of the invention being indicated by the appended claims rather than by the foregoing description. All changes which come within the meaning and range of equivalency of the claims are intended to be embraced therein.

I claim:

1. An adjustment knob assembly for selectably adjusting and securing an arrow deployment parameter of an archery bow, said adjustment knob assembly comprising:

a base block having opposite inner and outer base ends, a base throughbore communicating between the inner and outer base ends to define respective inner and outer base apertures, and an index surface of the outer base end surrounding the outer base aperture, the index surface having at least two detent recesses thereon surrounding the outer base aperture;

means for mounting the base block to the archery bow;

a pivot shaft received for rotation within the base throughbore, the pivot shaft having an input portion adjacent the outer base aperture and an opposite output portion extending beyond the inner base end, the output portion having means for selectably adjusting the arrow deployment parameter upon rotation of the pivot shaft;

means for obstructing relative axial displacement of the pivot shaft in an outward direction from the inner base end to the outer base end; and an adjustment knob having opposite inner and outer knob ends, the inner knob end adjacent the index surface of the base block and fixedly connected to the input portion of the pivot shaft for controlling rotation thereof, detent means of the inner knob end for resiliently-biasing between engaged and disengaged positions with respect to the detent recesses, and fastener means for retractably extending an abutment member from the inner knob end in an inward direction into press-engagement with respect to the detent recesses so as to releasably secure the adjustment knob to the base block by a clamping force produced by the press-engagement.

2. The adjustment knob assembly as in claim 1, wherein the fastener means includes an actuator member operably connected to the abutment member from beyond the outer knob end, for hand actuating the abutment member to retractably extend into press-engagement with respect to the detent recesses.

3. The adjustment knob assembly as in claim 2, wherein the adjustment knob has a threaded knob throughbore communicating between the inner and outer knob ends, the abutment member is a threaded shank received for threaded rotation within the threaded knob throughbore, and the actuator member is a knob head having a grasp surface for grasp-rotating the threaded shank to retractably extend into press-engagement with respect to the detent recesses.

4. The adjustment knob assembly as in claim 1, wherein the output portion of the pivot shaft has an external thread to produce worm-drive adjustment of the arrow deployment parameter upon rotation of the pivot shaft.

5. The adjustment knob assembly as in claim 4, wherein the external thread of the output portion has a thread diameter greater than a diameter of the inner base aperture of the inner base end so as to obstruct relative axial displacement of the pivot shaft in an outward direction from the inner base end to the outer base end.

6. The adjustment knob assembly as in claim 1, wherein the inner knob end of the adjustment knob has an inner deck surface and an annular shoulder surrounding the inner deck surface to form a knob cavity, and the outer base end of the base block has a generally disc-shaped seat portion which delimits the index surface within a circular perimeter and through which the base throughbore centrally communicates, the seat portion being matingly received within the knob cavity to confront the index surface of the seat portion with the inner deck surface.

7. The adjustment knob assembly as in claim 1, wherein the index surface has a plurality of detent recesses surrounding the outer base aperture.

8. The adjustment knob assembly as in claim 1, wherein the detent means comprises spring-loaded ball-bearings for rollably engaging and disengaging the detent recesses.

9. An adjustment knob assembly for selectably adjusting and securing an arrow deployment parameter of an archery bow, said adjustment knob assembly comprising:

a base block having opposite inner and outer base ends, a base throughbore communicating between the inner and outer base ends to define respective inner and outer base apertures, and an index surface of the outer base end surrounding the outer base aperture, the index surface having at least two detent recesses thereon surrounding the outer base aperture;

means for mounting the base block to the archery bow;

a pivot shaft received for rotation within the base throughbore, the pivot shaft having an input portion adjacent the outer base aperture and an opposite output portion extending beyond the inner base end, the output portion having means for selectably adjusting the arrow deployment parameter upon rotation of the pivot shaft;

means for obstructing relative axial displacement of the pivot shaft in an outward direction from the inner base end to the outer base end;

an adjustment knob having opposite inner and outer knob ends with a threaded knob throughbore communicating therebetween, the inner knob end adjacent the index surface of the base block and fixedly connected to the input portion of the pivot shaft for controlling rotation thereof, and detent means of the inner knob end for resiliently-biasing between engaged and disengaged positions with respect to the detent recesses; and a screw fastener having a threaded shank received for threaded rotation within the threaded knob throughbore of the adjustment knob, and a knob head connected to the threaded shank from beyond the outer knob end, the knob head having a grasp surface for grasp-rotating the threaded shank to retractably extend from the adjustment knob in an inward direction into press-engagement with respect to the detent recesses so as to releasably secure the adjustment knob to the base block by a clamping force produced by the press-engagement.

10. The adjustment knob assembly as in claim 9, wherein the output portion of the pivot shaft has an external thread to produce worm drive adjustment of the arrow deployment parameter upon rotation of the pivot shaft.

11. The adjustment knob assembly as in claim 10, wherein the external thread of the output portion has a thread diameter greater than a diameter of the inner base aperture of the inner base end so as to obstruct relative axial displacement of the pivot shaft in an outward direction from the inner base end to the outer base end.

12. The adjustment knob assembly as in claim 9, wherein the inner knob end of the adjustment knob has an inner deck surface and an annular shoulder surrounding the inner deck surface to form a knob cavity, and the outer base end of the base block has a generally disc-shaped seat portion which delimits the index surface within a circular perimeter and through which the base throughbore centrally communicates, the seat portion being matingly received within the knob cavity to confront the index surface of the seat portion with the inner deck surface.

13. The adjustment knob assembly as in claim 9, wherein the index surface has a plurality of detent recesses surrounding the outer base aperture.

14. The adjustment knob assembly as in claim 9, wherein the detent means comprises spring-loaded ball-bearings for rollably engaging and disengaging the detent recesses.

15. An adjustment knob assembly for selectably adjusting and securing an arrow deployment parameter of an archery bow, said adjustment knob assembly comprising:

a base block having an inner base end, an opposite outer base end with a generally disc-shaped seat portion, a base throughbore communicating between the inner base end and the seat portion to define respective inner and outer base apertures, and a perimetrically circular index surface of the seat portion concentrically surrounding the outer base aperture, the index surface having at least two detent recesses thereon surrounding the outer base aperture;

means for mounting the base block to the archery bow;

a pivot shaft received for rotation within the base throughbore, the pivot shaft having an input portion adjacent the outer base aperture and an opposite output portion extending beyond the inner base end, the output portion having means for selectably adjusting the arrow deployment parameter upon rotation of the pivot shaft;

means for obstructing relative axial displacement of the pivot shaft in an outward direction from the inner base end to the outer base end; and an adjustment knob having an outer knob end and an opposite inner knob end adjacent the seat portion of the base block, the inner knob end having an inner deck surface centrally and fixedly connected to the input portion of the pivot shaft for controlling rotation thereof and an annular shoulder surrounding the inner deck surface to form a knob cavity, the knob cavity matingly receiving the seat portion to confront the index surface with the inner deck surface, detent means of the inner deck surface for resiliently-biasing between engaged and disengaged positions with respect to the detent recesses, and fastener means for retractably extending an abutment member from the inner deck surface in an inward direction into press-engagement with respect to the detent recesses so as to releasably secure the adjustment knob to the base block by a clamping force produced by the press-engagement.

16. The adjustment knob assembly as in claim 15, wherein the fastener means includes an actuator member operably connected to the abutment member from beyond the outer knob end, for hand actuating the abutment member to retractably extend into press-engagement with respect to the detent recesses.

17. The adjustment knob assembly as in claim 16, wherein the adjustment knob has a threaded knob throughbore communicating between the inner and outer knob ends, the abutment member is a threaded shank received for threaded rotation within the threaded knob throughbore, and the actuator member is a knob head having a grasp surface for grasp-rotating the threaded shank to retractably extend into press-engagement with respect to the detent recesses.

18. The adjustment knob assembly as in claim 17, wherein the external thread of the output portion has a thread diameter greater than a diameter of the inner base aperture of the inner base end so as to obstruct relative axial displacement of the pivot shaft in an outward direction from the inner base end to the outer base end.

19. The adjustment knob assembly as in claim 15, wherein the output portion of the pivot shaft has an external thread to produce worm-drive adjustment of the arrow deployment parameter upon rotation of the pivot shaft.

20. The adjustment knob assembly as in claim 15, wherein the index surface has a plurality of detent recesses surrounding the outer base aperture.

21. The adjustment knob assembly as in claim 15, wherein the detent means comprises spring-loaded ball-bearings for rollably engaging and disengaging the detent recesses.

* * * * *